US008720307B2

(12) United States Patent
Shu

(10) Patent No.: US 8,720,307 B2
(45) Date of Patent: May 13, 2014

(54) RATCHET SCREWDRIVER

(76) Inventor: Zu-Shung Shu, Taichung (TW)

( * ) Notice: Subject to any disclaimer, the term of this patent is extended or adjusted under 35 U.S.C. 154(b) by 318 days.

(21) Appl. No.: 13/218,539

(22) Filed: Aug. 26, 2011

(65) Prior Publication Data

US 2012/0318104 A1 Dec. 20, 2012

(30) Foreign Application Priority Data

Jun. 15, 2011 (TW) ..... 100120923 A

(51) Int. Cl.
*B25B 13/46* (2006.01)

(52) U.S. Cl.
USPC ..... 81/63.1

(58) Field of Classification Search
USPC ..... 81/62, 63.1, 58.4; 192/43, 43.1
See application file for complete search history.

(56) References Cited

U.S. PATENT DOCUMENTS

| | | | | | |
|---|---|---|---|---|---|
| 819,536 | A * | 5/1906 | Furbish | 192/43.1 |
| 4,581,962 | A * | 4/1986 | Marbourg | 81/451 |
| 4,696,208 | A * | 9/1987 | Lay | 81/63.1 |
| 5,582,081 | A * | 12/1996 | Lin | 81/63.1 |
| 5,609,078 | A * | 3/1997 | Yang | 81/63.1 |
| 6,059,083 | A * | 5/2000 | Tseng | 192/43.1 |
| 6,435,061 | B1 | 8/2002 | Ho | 81/58.4 |

* cited by examiner

*Primary Examiner* — Hadi Shakeri
(74) *Attorney, Agent, or Firm* — Alan Kamrath; Kamrath IP Lawfirm, P.A.

(57) ABSTRACT

A ratchet screwdriver includes an adjusting assembly. The adjusting assembly is selectively changable between a first position, a second position, and a third position. When the adjusting assembly is in the first position, a rib is located between the first and second ends of a slanting slot. First and second pawls are engaged with a ratchet portion. A position assembly is engaged in a first bore. A shank is able to drive the screwdriver bit in a clockwise direction or a counterclockwise direction. When the adjusting assembly is in the second position, the shank is able to drive the screwdriver bit in the clockwise direction. When the adjusting assembly is in the third position, the shank is able to drive the screwdriver bit in the counterclockwise direction.

10 Claims, 17 Drawing Sheets

RATCHET SCREWDRIVER

BACKGROUND OF THE INVENTION

1. Field of the Invention

The present invention relates to a ratchet screwdriver and, in particular, to a ratchet screwdriver which can change driving direction by rotating a shifter.

2. Description of the Related Art

U.S. Pat. No. 6,435,061 discloses a ratchet screwdriver including a handle, a main body, a shank, two check plates, a shifter, a position confining plate, and a tubular housing. Therefore, when a user holds and rotates the handle to drive the shank about an axis of the ratchet screwdriver, the user slides the shifter axially to change the driving direction of the shank. It is unreasonable and inconvenient to change the action of the user in the operating process.

Therefore, there is a need for a ratchet screwdriver that overcomes the above problems and that provides a more reasonable and convenient driving way.

Further, a ratchet screwdriver is desired including a shifter able to be changed by the user in a direction, which is the same as holding and rotating the handle. Still further, there is a need for a ratchet screwdriver that provides an uncluttered, aesthetically pleasing appearance.

Therefore, a need exists for a ratchet screwdriver intended to obviate or at least alleviate the problems encountered in the prior art.

SUMMARY OF THE INVENTION

According to the present invention, a ratchet screwdriver includes a handle, a main body, a shifter, a shank, and an adjusting assembly. The handle includes a holding end and a connecting end opposite to the holding end. The main body connects with the connecting end. The main body includes a recess disposed radially and an axial hole disposed axially connecting and communication with the recess. The main body further includes a position assembly. The shifter includes a first pawl, a second pawl, and a plate body including a first foot and a second foot formed opposite to the first foot. The first and second pawls are located in the recess. The shifter further includes a rib formed on a surface opposite to the first and second feet. The first foot abuts against the first pawl, and the second foot abuts against the second pawl. The shank includes a ratchet portion and a tubular body. The ratchet portion enters in the recess via the axial hole. The tubular body is able to connect a screwdriver bit. The adjusting assembly is selectable to be changed between a first position, a second position, and a third position. When the adjusting assembly is in the first position, the rib is located between the first and second ends of the slanting slot. The first and second pawls are engaged with the ratchet portion. The position assembly is engaged in the first bore. The shank is able to drive the screwdriver bit in a clockwise direction or a counterclockwise direction. When the adjusting assembly is in the second position, the shank is able to drive the screwdriver bit in the clockwise direction. When the adjusting assembly is in the third position, the shank is able to drive the screwdriver bit in the counterclockwise direction.

It is an object of the present invention to provide a ratchet screwdriver including the adjusting assembly rotatable with respect to the main body about an axis of the screwdriver extending from the handle to the shank, so that a user holds and rotates the handle to drive the shank about the axis, which is similar to the adjusting assembly rotated about the axis to change the direction for driving a screwdriver bit.

It is another object of the present invention to provide a ratchet screwdriver that has fewer elements to manufacture easily and to reduce the assembling cost.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
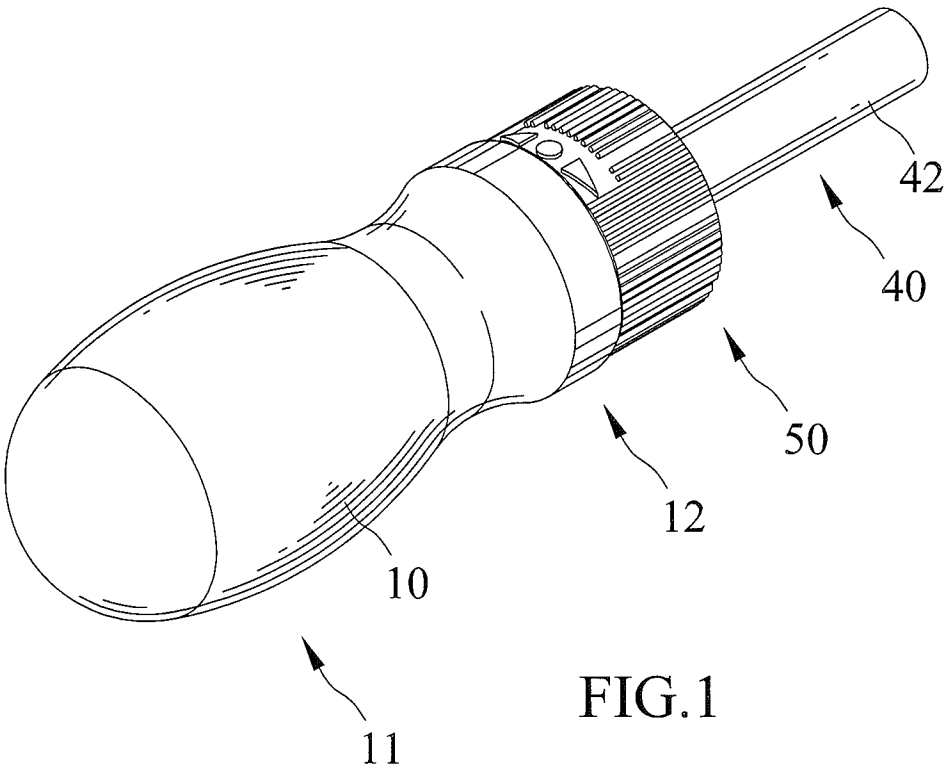
FIG. 1 is a perspective view of a ratchet screwdriver in accordance with a first embodiment of the present invention.
Figure 2:
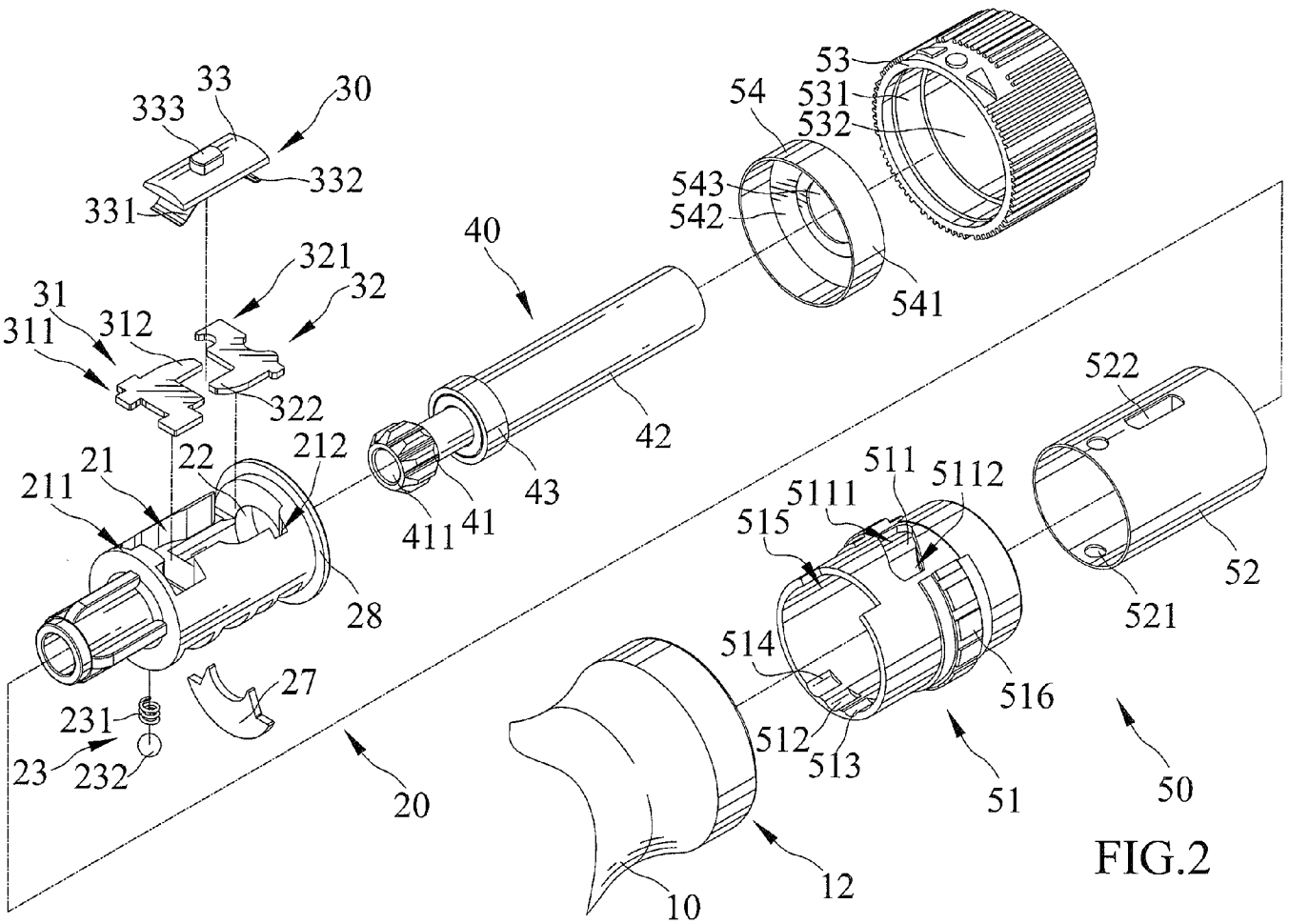
FIG. 2 is an exploded perspective view of the ratchet screwdriver shown in FIG. 1.
Figure 3:
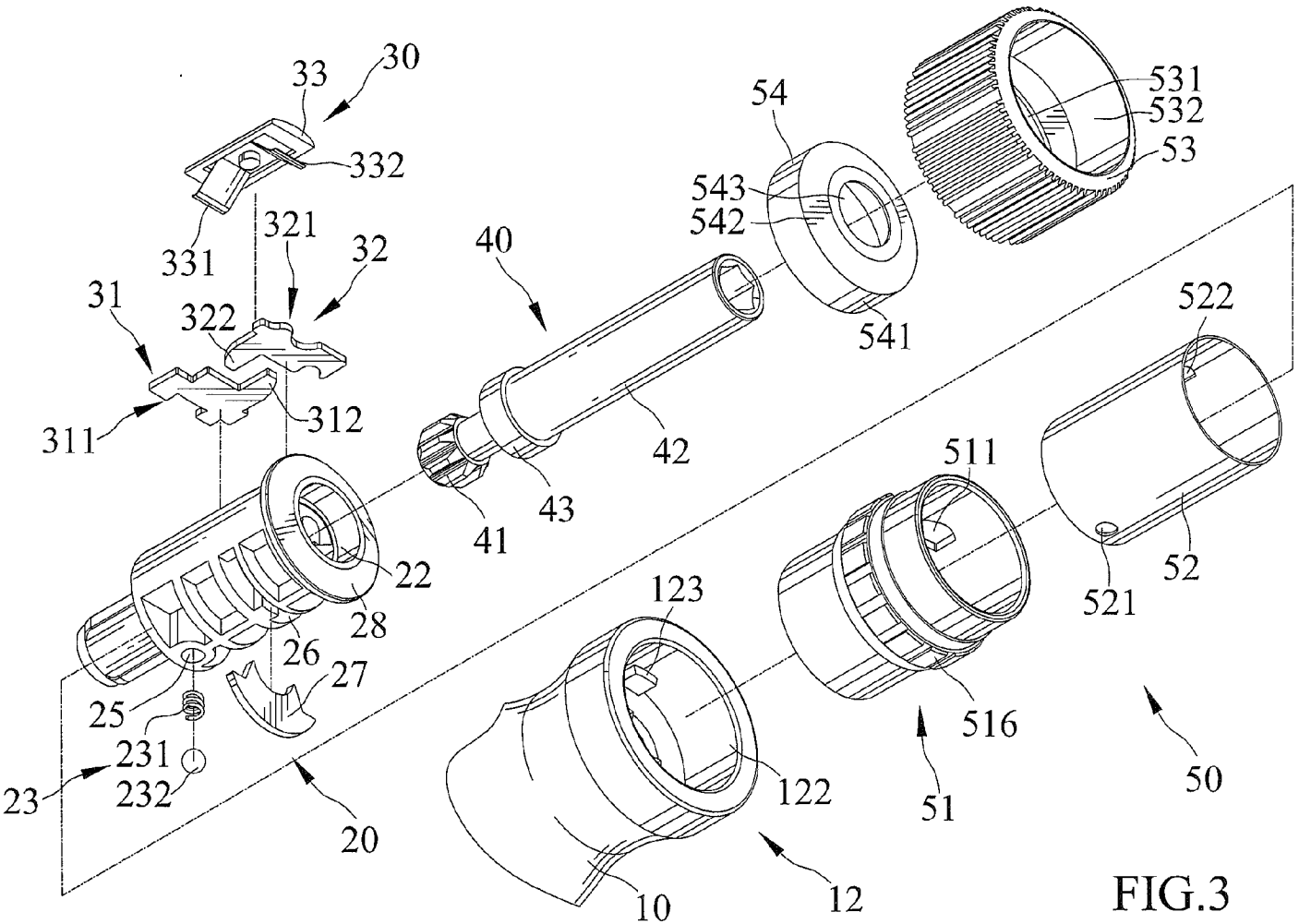
FIG. 3 is another exploded perspective view of the ratchet screwdriver shown in FIG. 1.
Figure 4:
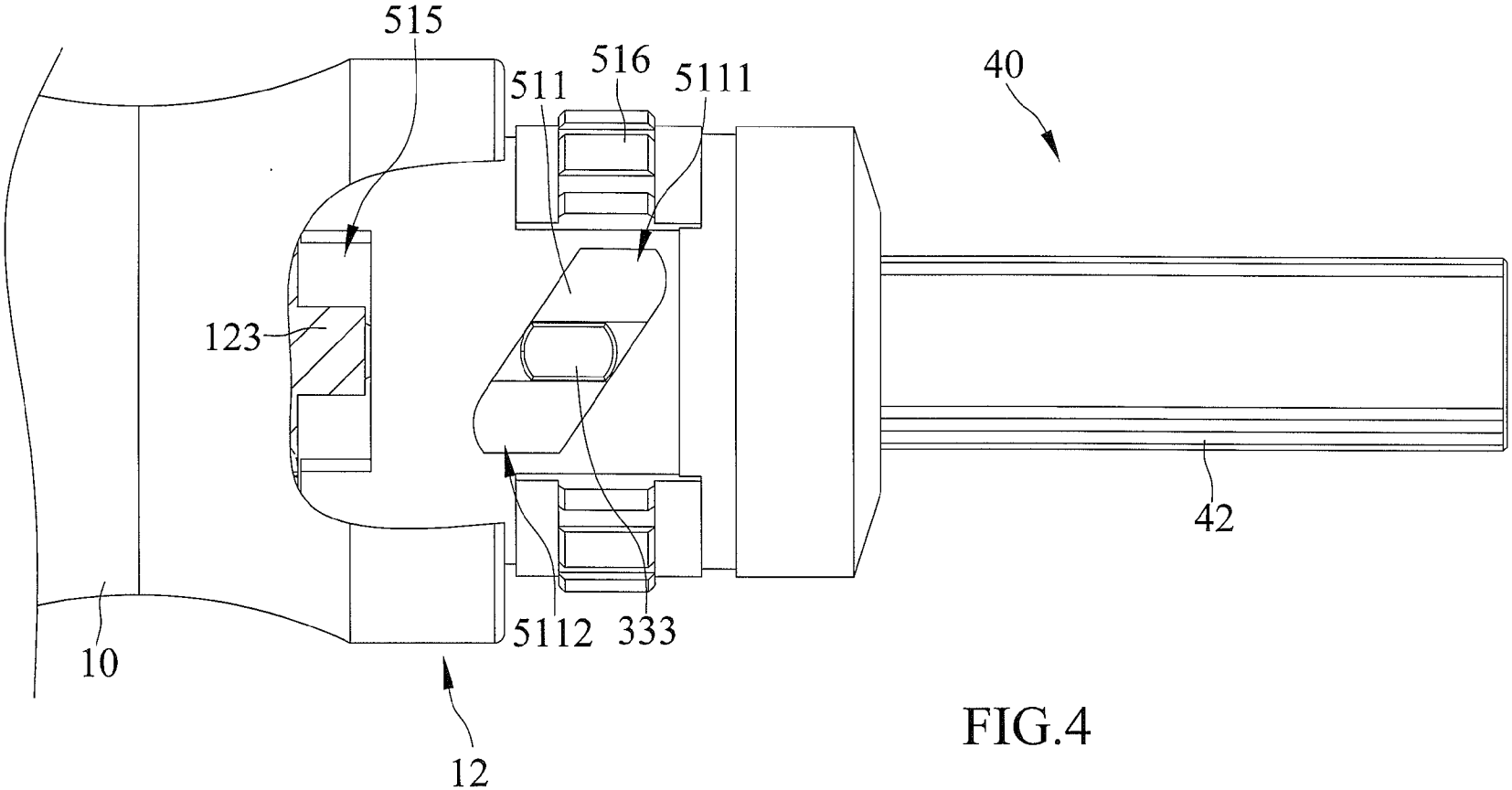
FIG. 4 is a cross-sectional view of the ratchet screwdriver of FIG. 1 illustrating a plate body located between a first end of the slanting slot and a second end of the slanting slot.
Figure 5:
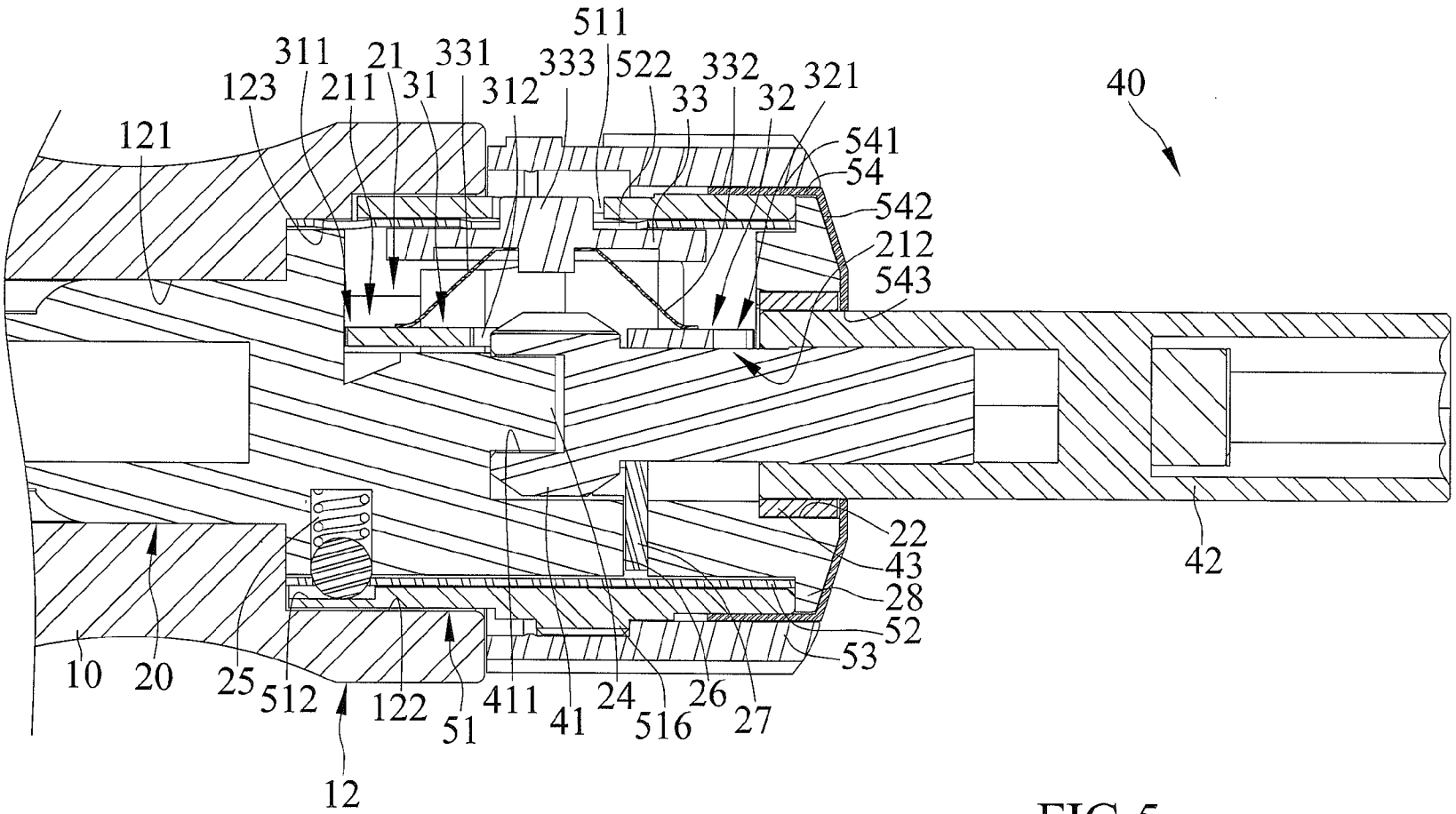
FIG. 5 is a cross-sectional view of the ratchet screwdriver of FIG. 1 illustrating the plate body abutting against a first pawl and a second pawl.
Figure 7:
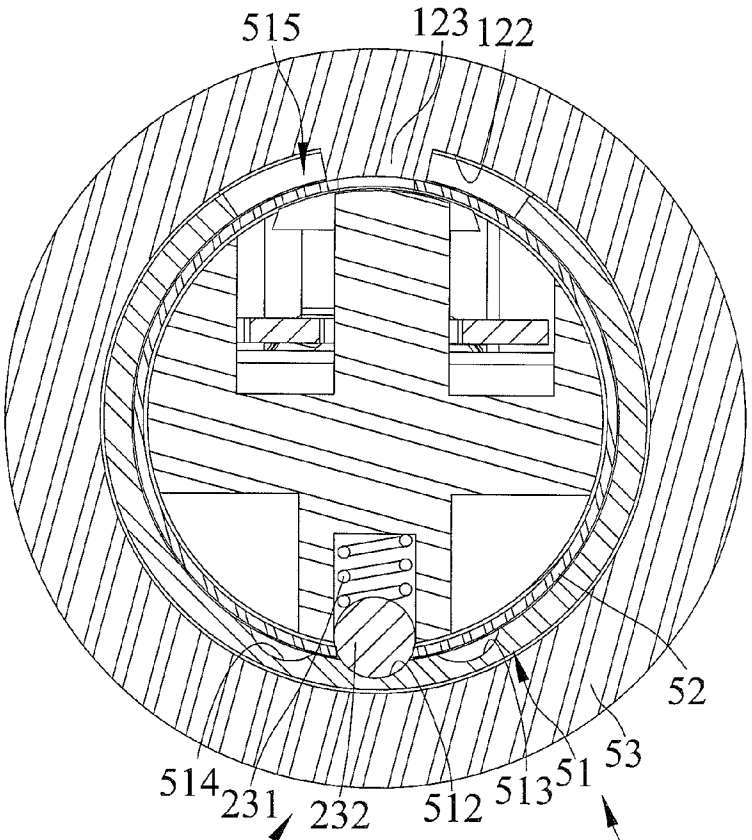
FIG. 7 is a cross-sectional view of the ratchet screwdriver of FIG. 1 illustrating a position unit engaged in a first bore.
Figure 6:
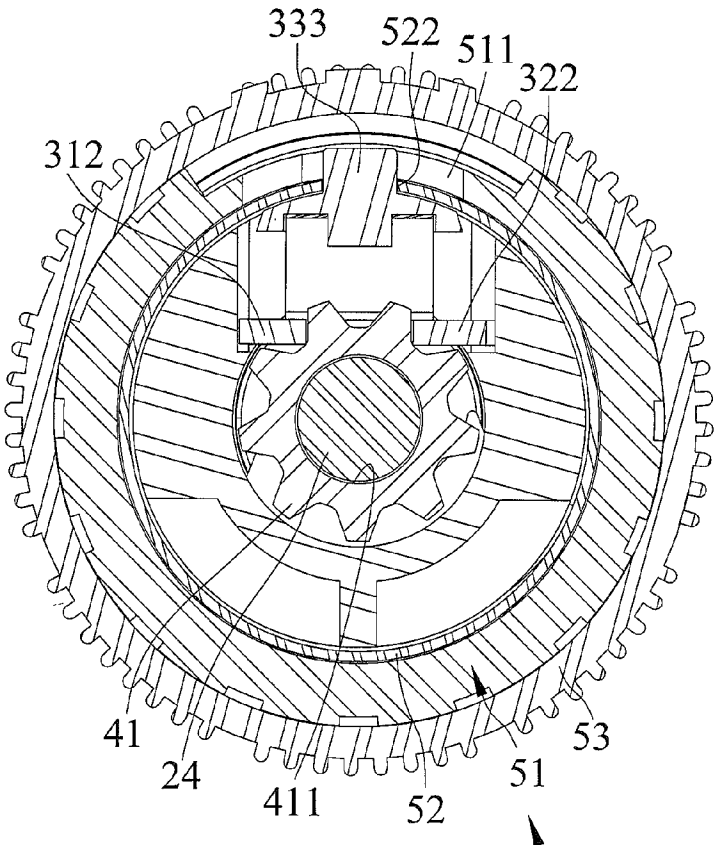
FIG. 6 is a cross-sectional view of the ratchet screwdriver of FIG. 1 illustrating the first and second pawls engaged with a ratchet portion.
Figure 8:
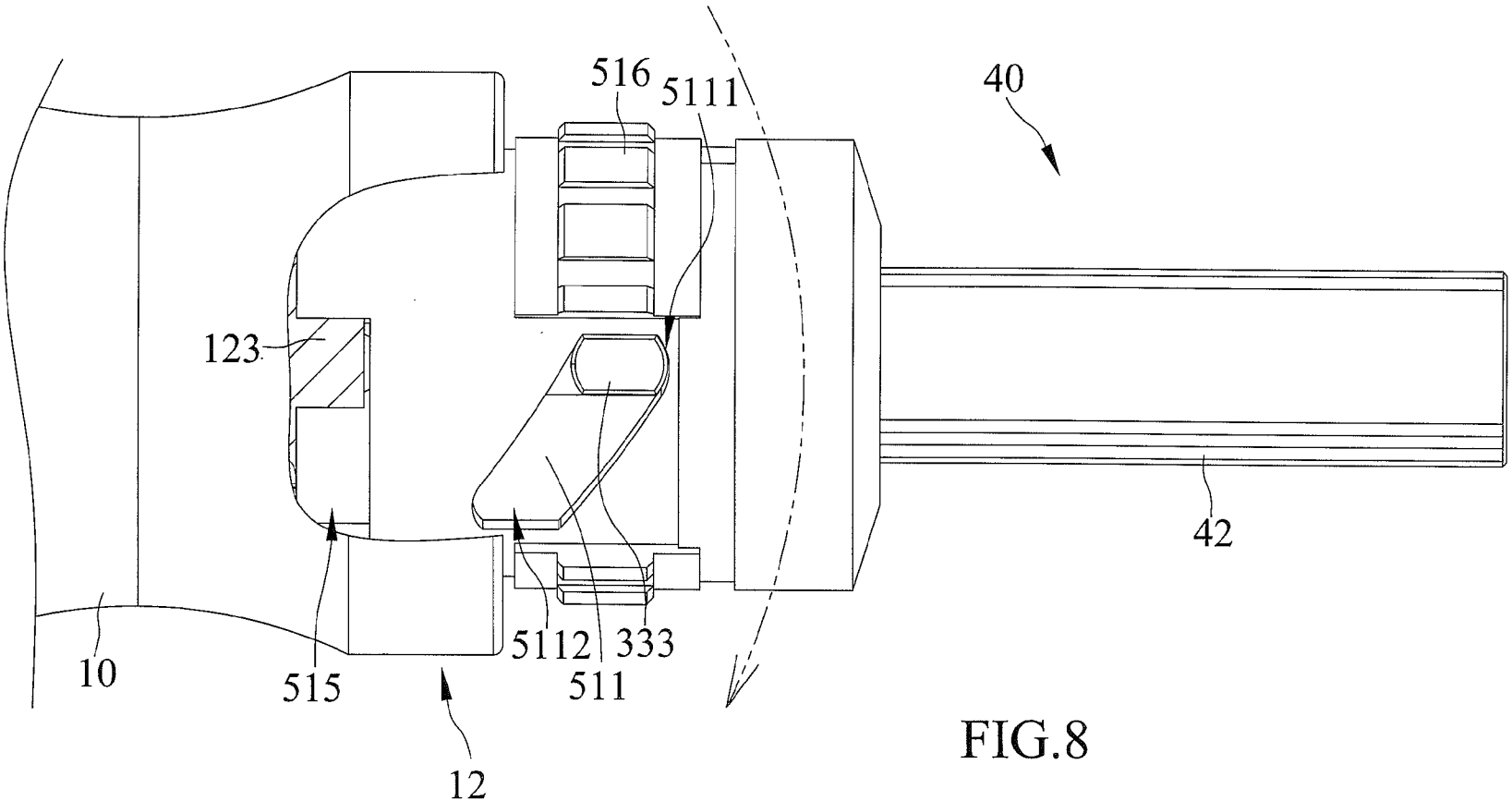
FIG. 8 is a side view illustrating the plate body located at the first end of the slanting slot.
Figure 9:
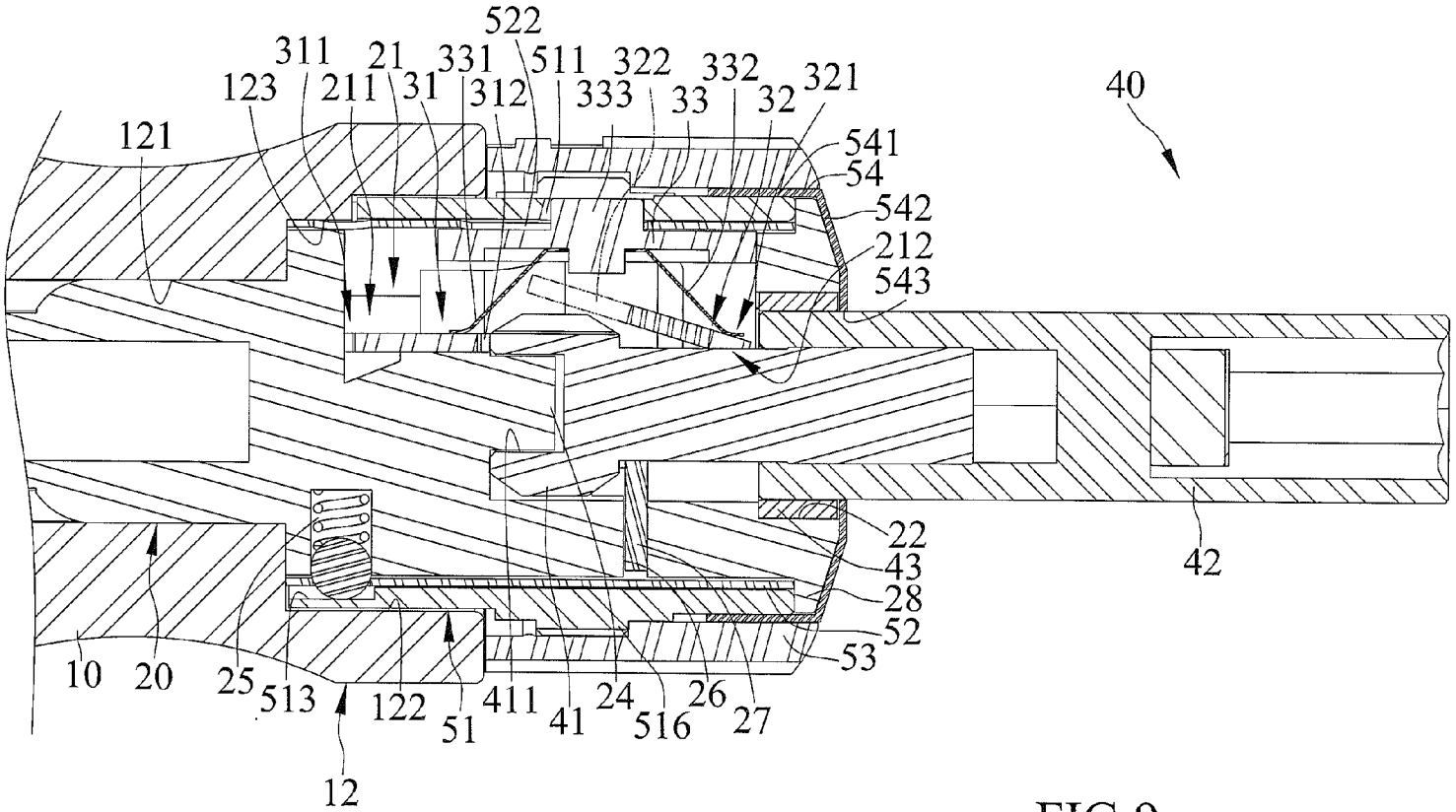
FIG. 9 is a cross-sectional view of the ratchet screwdriver of FIG. 1 illustrating the plate body abutting against the second pawl.
Figure 11:
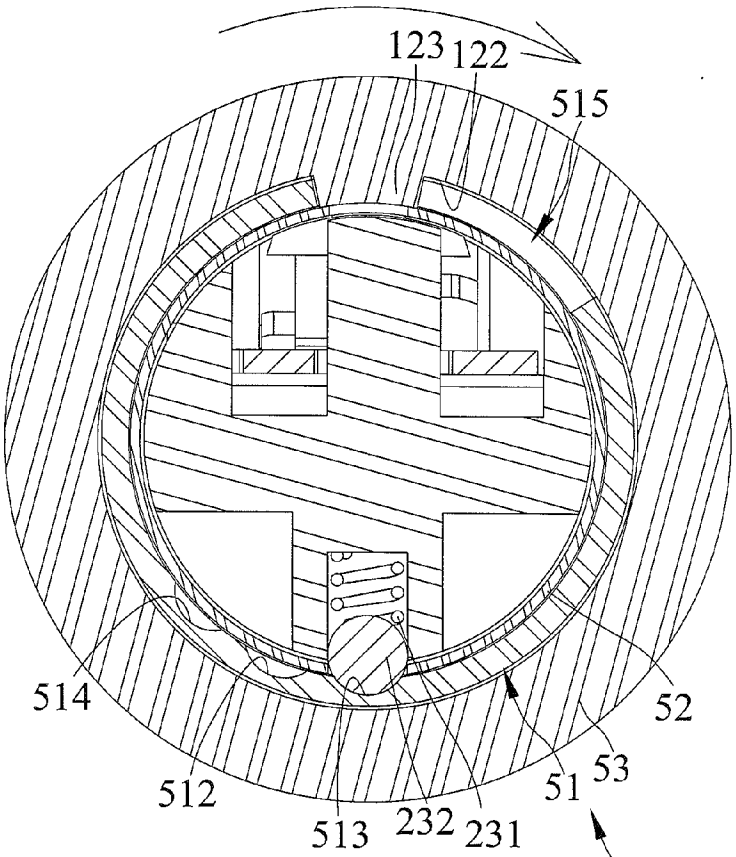
FIG. 11 is a cross-sectional view of the ratchet screwdriver of FIG. 1 illustrating the position unit engaged in a second bore.
Figure 10:
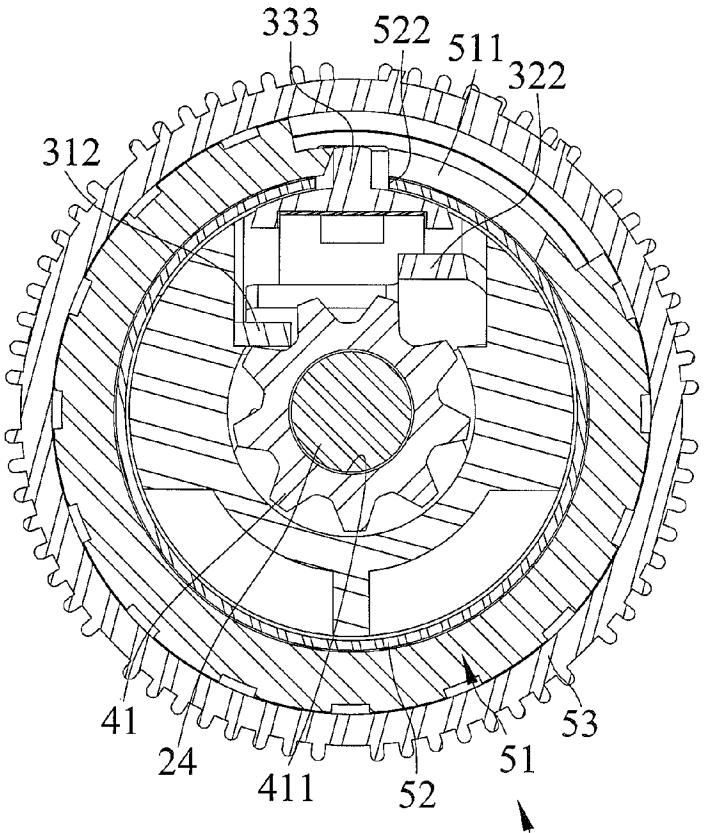
FIG. 10 is a cross-sectional view of the ratchet screwdriver of FIG. 1 illustrating the first pawl engaged with the ratchet portion.
Figure 12:
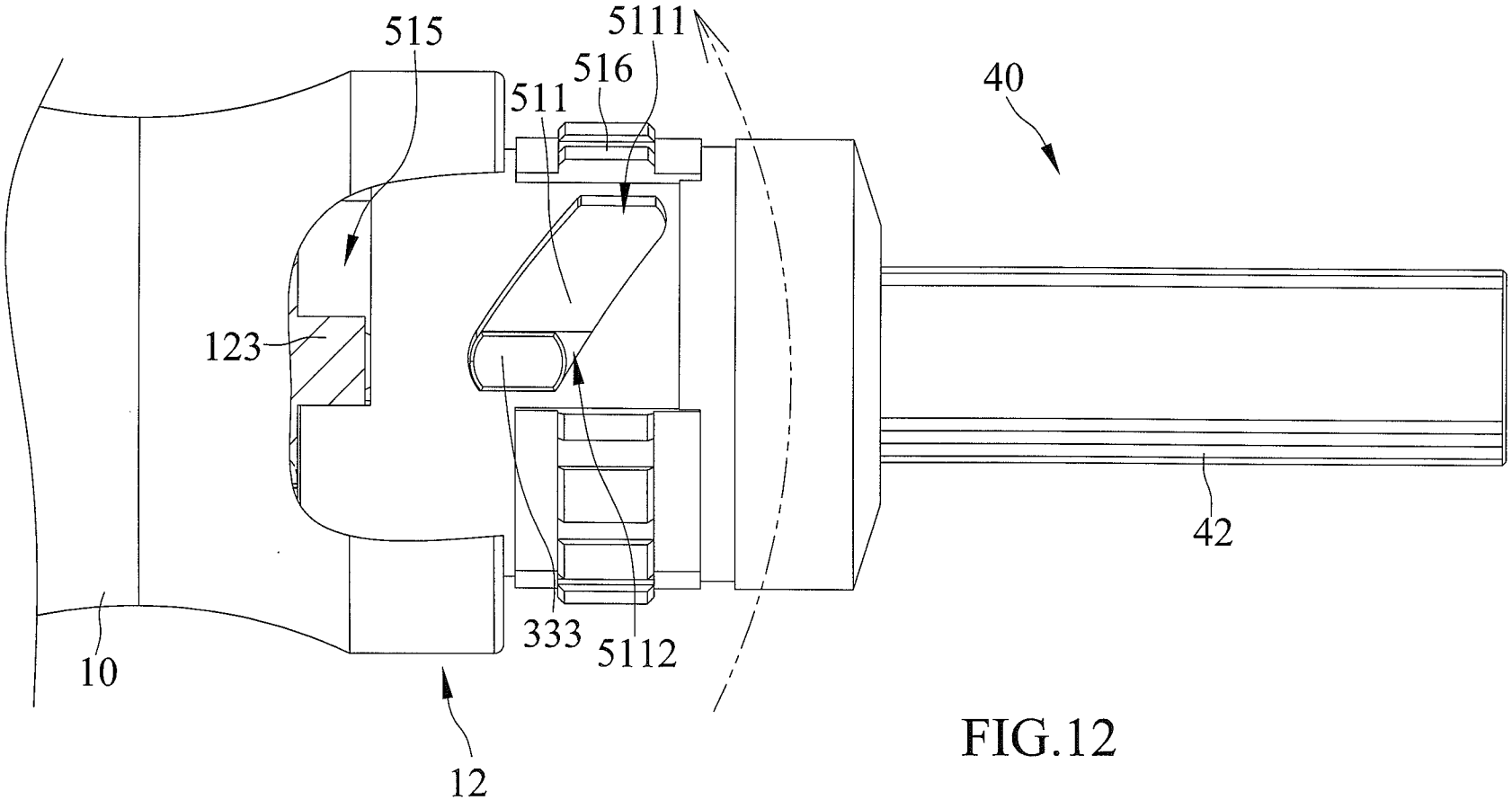
FIG. 12 is a side view of the ratchet screwdriver of FIG. 1 illustrating the plate body located at the second end of the slanting slot.
Figure 13:
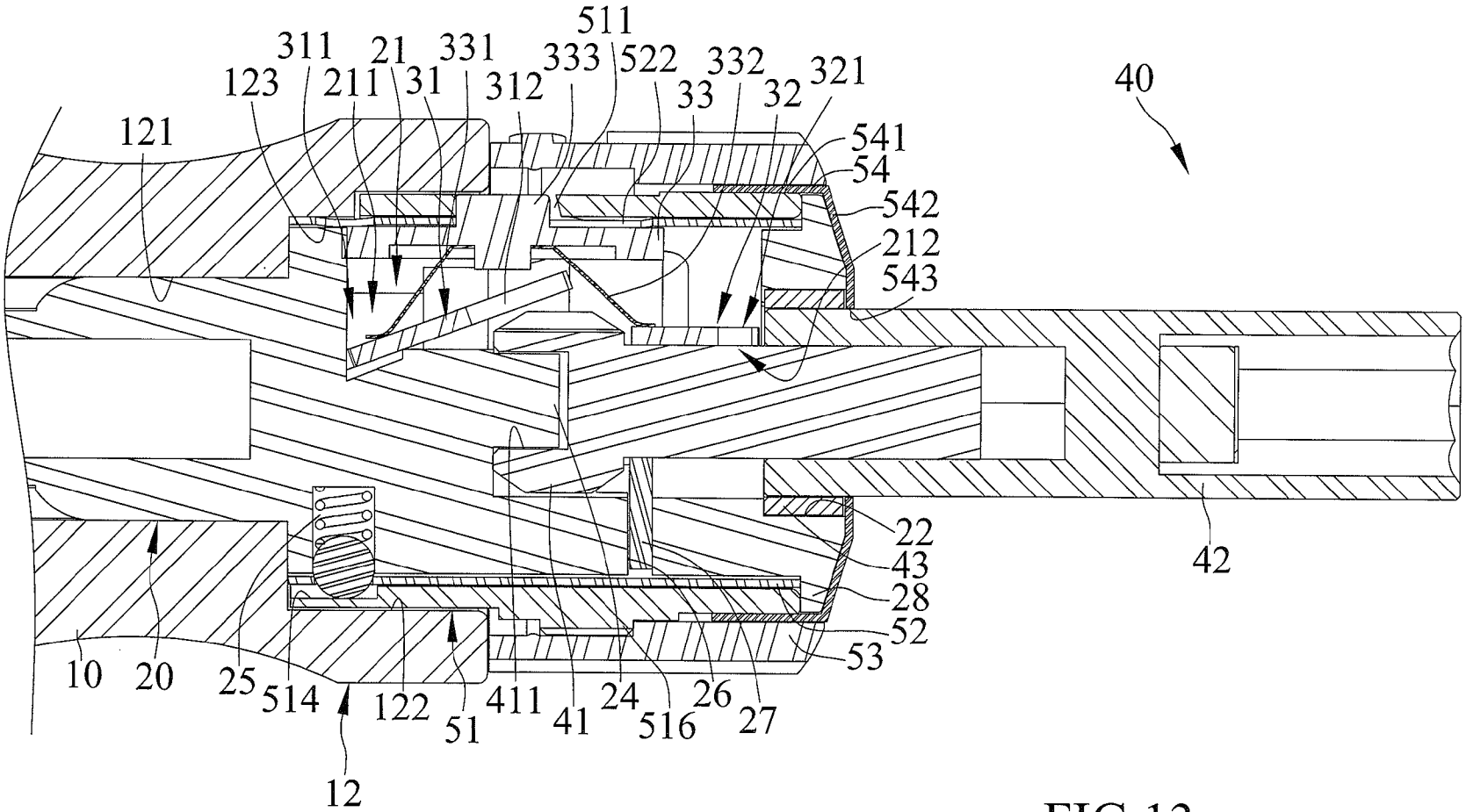
FIG. 13 is a cross-sectional view of the ratchet screwdriver of FIG. 1 illustrating the plate body abutting against the first pawl.
Figure 15:
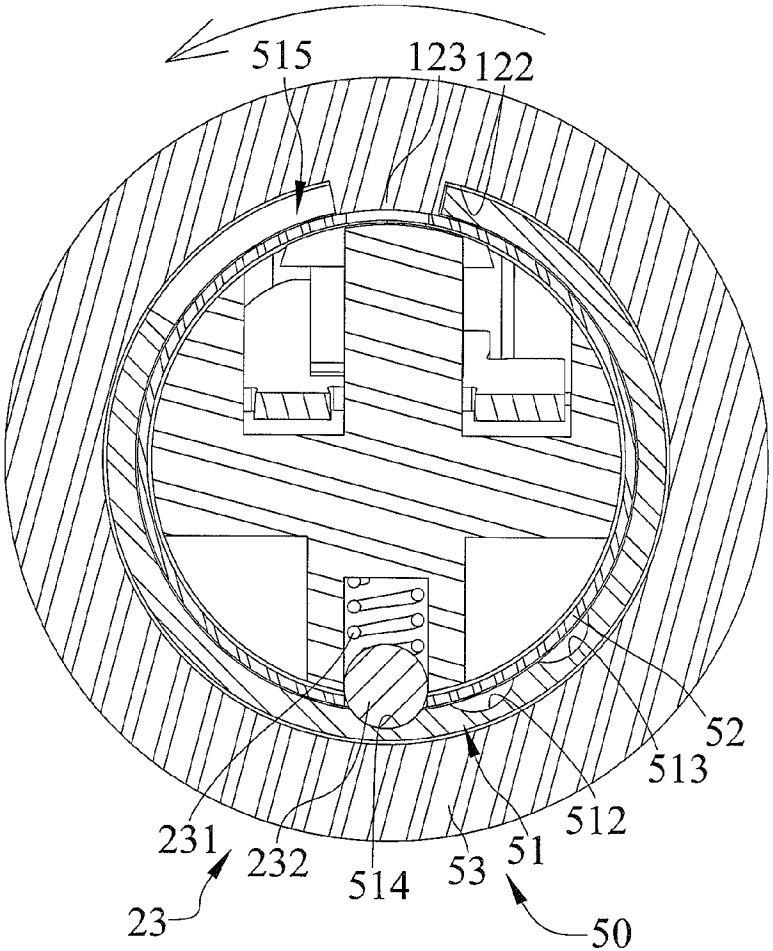
FIG. 15 is a cross-sectional view of the ratchet screwdriver of FIG. 1 illustrating the position unit engaged in a third bore.
Figure 14:
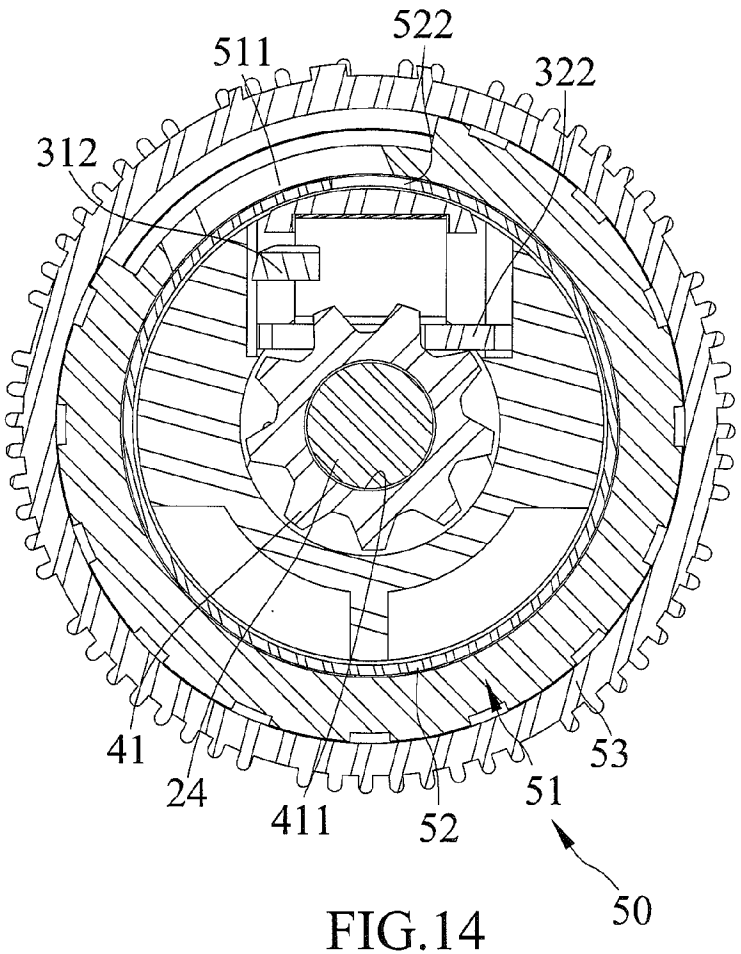
FIG. 14 is a cross-sectional view of the ratchet screwdriver of FIG. 1 illustrating the second pawl engaged with the ratchet portion.

Referring to FIGS. 1 through 15, a ratchet screwdriver according to the first embodiment of the present invention includes a handle 10, a main body 20, a shifter 30, a shank 40, and an adjusting assembly 50.

The handle 10 includes a holding end 11 and a connecting end 12 opposite to the holding end 11. The holding end 11 is held by a user. The connecting end 12 connects with the main body 20. The main body 20 includes a recess 21 disposed radially therein and a axial hole 22 disposed axially connecting and communication with the recess 21. The main body 20 further includes a position assembly 23. The shifter 30 includes a first pawl 31, a second pawl 32, and a plate body 33. The first and second pawls 31 and 32 are located in the recess 21. The plate body 33 includes a first foot 331, a second foot 332 formed opposite to the first foot 331, and a rib 333 formed on a surface opposite to the first and second feet 331, 332. The first foot 331 abuts against the first pawl 31, and the second foot 332 abuts against the second pawl 32. The shank 40 includes a ratchet portion 41 and a tubular body 42 formed opposite to the ratchet portion 41. The ratchet portion 41 enters in the recess 21 via the axial hole 22. The tubular body 42 is able to connect with a screwdriver bit. The adjusting assembly 50 is adapted to receive the main body 20. The adjusting assembly 50 includes an adjusting ring 51, which includes a slanting slot 511, a first bore 512, a second bore 513, and a third bore 514. The slanting slot 511 includes a first end 5111 and a second end 5112 disposed opposite to the first end 5111. The rib 333 of the plate body 33 is exposed from the slanting slot 511. The position assembly 23 is selectable to abut against the first, second, and third bores 512, 513, and 514.

The adjusting assembly 50 is rotatable with respect to the main body 20 about an axis of the screwdriver extending from the handle 10 to the shank 40. The adjusting assembly 50 is selectively operable between a first position, a second position, and a third position.

When the adjusting assembly 50 is disposed in the first position, the rib 333 of the plate body 33 is located between the first and second ends 5111, 5112 of the slanting slot 511, with the first and second pawls 31, 32 engaged with the ratchet portion 41, respectively. The position assembly 23 is engaged in the first bore 512. The shank 40 can drive the screwdriver bit in a clockwise direction, and the shank 40 can drive the screwdriver bit in a counterclockwise direction, too.

When the adjusting assembly 50 is disposed in the second position, the rib 333 of the plate body 33 is located at the first end 5111 of the slanting slot 511, with the first foot 331 abutting against the first pawl 31 to make the first pawl 31 engage with the ratchet portion 41, with the second foot 332 abutting against the second pawl 32 to make the second pawl 32 depart from the ratchet portion 41. The position assembly 23 is engaged in the second bore 513. The shank 40 can drive the screwdriver bit in the clockwise direction.

When the adjusting assembly 50 is disposed in the third position, the rib 333 of the plate body 33 is located at the second end 5112 of the slanting slot 511, with the first foot 331 abutting against the first pawl 31 to make the first pawl 31 depart from the ratchet portion 41, and with the second foot 332 abutting against the second pawl 32 to make the second pawl 32 engage with the ratchet portion 41. The position assembly 23 is engaged in the third bore 514. The shank 40 can drive the screwdriver bit in the counterclockwise direction.

The plate body 33 is disposed in the adjusting ring 51, which can be rotated to actuate the plate body 33 moving axially. The adjusting ring 51 actuates the plate body 33 to selectively abut against either of the first and second pawls 31, 32. An operating action of the user, which holds and rotates the handle 10 about the axis, and the adjusting assembly 50 is rotated about the same axis, too. It is reasonable and convenient to change the operating action of the user in the operating process. Moreover, the structure of the ratchet screwdriver is simple, so that the ratchet screwdriver has fewer elements to manufacture easily and to reduce the assembling cost and the manufacturing cost. Therefore, the ratchet screwdriver is satisfied at a low price.

The connecting end 12 includes a compelling hole 121 and a receiving hole 122 communicating with the compelling hole 121. The receiving hole 122 has a block 123 formed therein. An end of the main body 20 is coupled in the compelling hole 121, and the other end of the main body 20 is coupled in the receiving hole 122. A part of the recess 21 is exposed from the handle 10. The recess 21 includes a first limiting end 211 and a second limiting end 212 formed opposite to the first limiting end 211.

The main body 20 includes a raised portion 24 formed axially therein. The raised portion 24 and the axial hole 22 are along the axis of the screwdriver. The main body 20 further includes a receiving slot 25 and a groove 26 therein. The receiving slot 25 and the groove 26 are disposed opposite to the recess 21. The receiving slot 25 receives the position assembly 23 including a resilient element 231 and a ball 232. An end of the ball 232 abuts against the resilient element 231, and the other end of the ball 232 protrudes from the receiving slot 25. The groove 26 connects and communicates with the axial hole 22. The main body 20 includes an impeding element 27 received in the groove 26, and entering in the recess 21. The main body 20 further includes a flange 28 formed opposite to the handle 10.

The first pawl 31 includes a first protruded piece 311 and a first protruded edge 312 disposed opposite to the first protruded piece 311. The first protruded edge 312 is able to engage with the ratchet portion 41 of the shank 40. The second pawl 32 includes a second protruded piece 321 and a second protruded edge 322 disposed opposite to the second protruded piece 321. The second protruded edge 322 is able to engage with the ratchet portion 41 of the shank 40. The first and second feet 331, 332 are substantially formed in an inverse V-shape. The plate body 33 is moveable with respect to the first and second pawls 31, 32. Therefore, the first foot 331 selectively abuts against the first pawl 31, and the second foot 332 selectively abuts against the second pawl 32.

The ratchet portion 41 includes a tip slot 411 formed axially therein. The tip slot 411 receives the raised portion 24, so that the impeding element 27 abuts against a distal end of the ratchet portion 41. Therefore, the shank 40 is supported by the raised portion 24 and the impeding element 27. The impeding element 27 avoids the shank 40 departing from the main body 20. The tubular body 42 of the shank 40 includes a fitting ring 43 adjacent to the ratchet portion 41. The fitting ring 43 is received in the axial hole 22.

The adjusting assembly 50 includes a sheath 52, a sleeve 53, and a cap 54. The adjusting ring 51 receives the main body 20, and abuts against the flange 28. The sheath 52 is located between the adjusting ring 51 and the main body 20. The sheath 52 abuts against the flange 28 of the main body 20. The sleeve 53 receives the adjusting ring 51. The cap 54 is located between the adjusting ring 51 and the sleeve 53. The adjusting ring 51 includes a gap 515 formed on a side of the adjusting ring 51 forming the slanting slot 511. The gap 515 receives the block 123. When the adjusting ring 51 is rotated with respect to the handle 10, the gap 515 receives the block 123. The first, second, and third bores 512, 513, and 514 are disposed on a side of the adjusting ring 51 opposite to the slanting slot 511. The adjusting ring 51 includes a convex portion 516 disposed with the slanting slot 511 at a same radial position therein. The sheath 52 includes an aperture 521 and a sliding slot 522 formed opposite to the aperture 521. The sleeve 53 is generally annular in shape. An inner circumference of the sleeve 53 includes a resisting area 531 and a packing area 532 disposed adjacent the resisting area 531 in a stepped drop way. A diameter of the packing area 532 is less than a diameter of the resisting area 531. The cap 54 includes a packing portion 541, a cover portion 542, and a through hole 543 formed on the cover portion 542. The packing portion 541 is generally annular in shape. The cover portion 542 is formed on a distal end of the packing portion 541. The cap 54 receives the main body 20 and the adjusting ring 51. The cover portion 542 abuts against a distal end of the flange 28 and the fitting ring 43. The packing portion 541 is received in the adjusting ring 51 and located at the packing area 532. The cap 54 avoids the shank 40 departing from the adjusting assembly 50. The adjusting ring 51 is restricted by the flange 28 of the main body 20, so that the adjusting ring 51 does not depart from the main body 20. The cap 54 is received in the adjusting ring 51 by close fitting. Consequently, the sleeve 53 and the cap 54 can not depart from the adjusting ring 51.

When the adjusting assembly 50 is in the first position, the rib 333 protrudes out the slanting slot 511, to be located between the first and second ends 5111, 5112 of the slanting slot 511. The first protruded piece 311 of the first pawl 31 is restricted by the first limiting end 211 of the recess 21. The first foot 331 abuts against the first pawl 31 to make the first protruded edge 312 engage with the ratchet portion 41. The second protruded piece 321 of the second pawl 32 is restricted by the second limiting end 212 of the recess 21. The second foot 332 abuts against the second pawl 32 to make the second protruded edge 322 engage with the ratchet portion 41. Moreover, the first and second pawls 31, 32 are engaged with the ratchet portion 41, respectively. The shank 40 can drive the screwdriver bit in a clockwise direction, and the shank 40 can drive the screwdriver bit in a counterclockwise direction, too.

Furthermore, the ball 232 of the position assembly 23 is abutted against by the resilient element 231 to position the ball 232 in the first bore 512. Therefore, the adjusting ring 51 of the adjusting assembly 50 is located in the first position, and can not actuate the plate body 33.

The user rotates the adjusting assembly 50 with respect to the main body 10 to change the adjusting assembly 50 to the second position. The rib 333 protrudes out the slanting slot 511, to be located at the first end 5111 of the slanting slot 511. The first protruded piece 311 of the first pawl 31 is restricted by the first limiting end 211 of the recess 21. The first foot 331 abuts against the first pawl 31 to engage the first protruded edge 312 with the ratchet portion 41. The second protruded piece 321 of the second pawl 32 is restricted by the second limiting end 212 of the recess 21. The second foot 332 abuts against the second protruded piece 321 of the second pawl 32 to disengage the second protruded edge 322 from the ratchet portion 41. Moreover, the first protruded edge 312 of the first pawl 31 is engaged with the ratchet portion 41. The second foot 332 of the second pawl 32 is disengaged with the ratchet portion 41, so that the shank 40 can drive the screwdriver bit in a clockwise direction.

Furthermore, the ball 232 of the position assembly 23 is abutted against by the resilient element 231 to position the ball 232 in the second bore 513. Therefore, the adjusting ring 51 of the adjusting assembly 50 is located in the second position, and can not actuate the plate body 33.

The user rotates the adjusting assembly 50 with respect to the main body 10 to change the adjusting assembly 50 to the third position. The rib 333 protrudes out the slanting slot 511, to be located at the second end 5112 of the slanting slot 511. The first protruded piece 311 of the first pawl 31 is restricted by the first limiting end 211 of the recess 21. The first foot 331 abuts against the first protruded piece 311 of the first pawl 31 to disengage the first protruded edge 312 from the ratchet portion 41. The second protruded piece 321 of the second pawl 32 is restricted by the second limiting end 212 of the recess 21. The second foot 332 abutting against the second pawl 32 engages the second protruded edge 322 with the ratchet portion 41. Moreover, the first protruded edge 312 of the first pawl 31 is disengaged with the ratchet portion 41. The second foot 332 of the second pawl 32 is engaged with the ratchet portion 41, so that the shank 40 can drive the screwdriver bit in a counterclockwise direction.

Furthermore, the ball 232 of the position assembly 23 is abutted against by the resilient element 231 to position the ball 232 in the third bore 514. Therefore, the adjusting ring 51 of the adjusting assembly 50 is located in the third position, and can not actuate the plate body 33.

Figure 16:
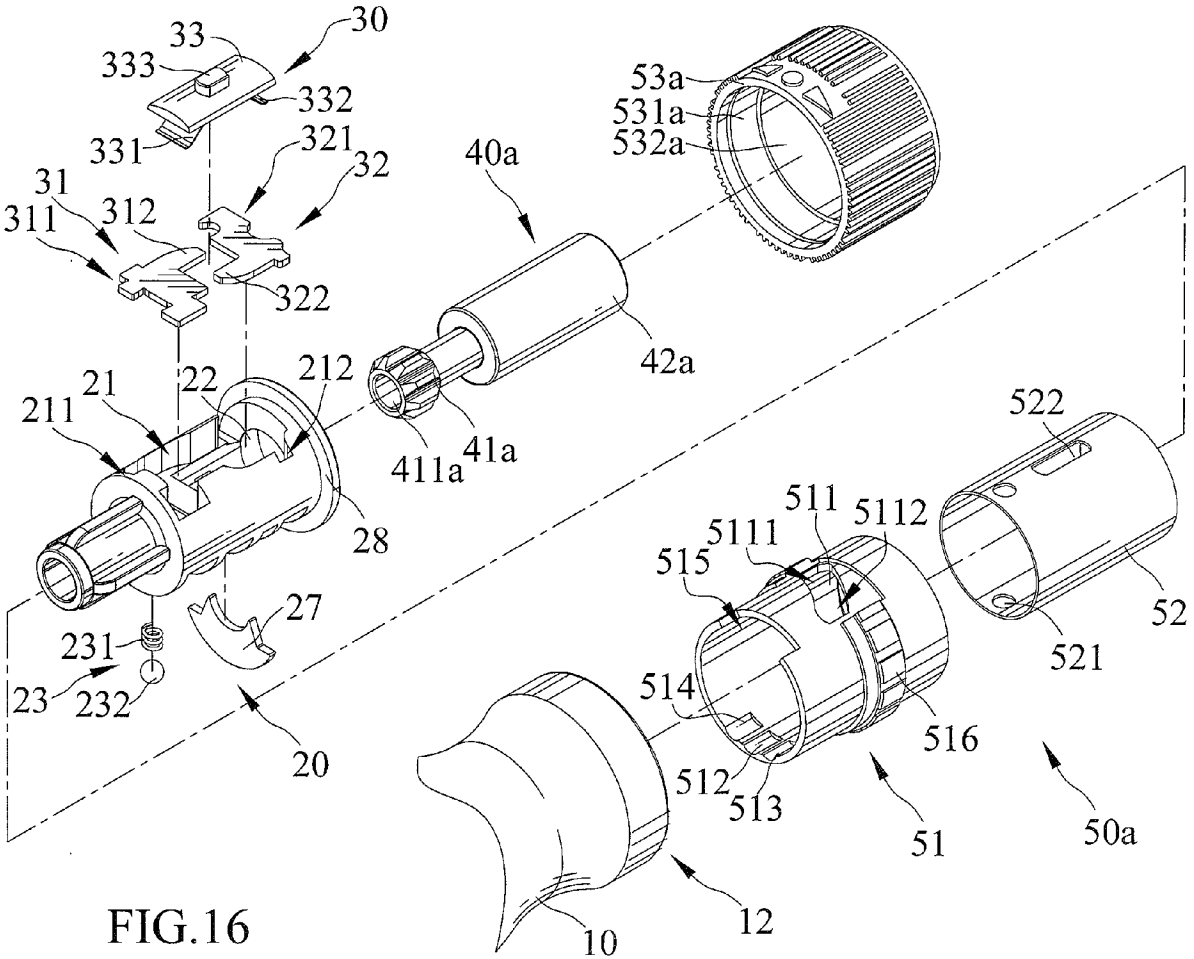
FIG. 16 is an exploded perspective view of the ratchet screwdriver in accordance with a second embodiment of the present invention.
Figure 17:
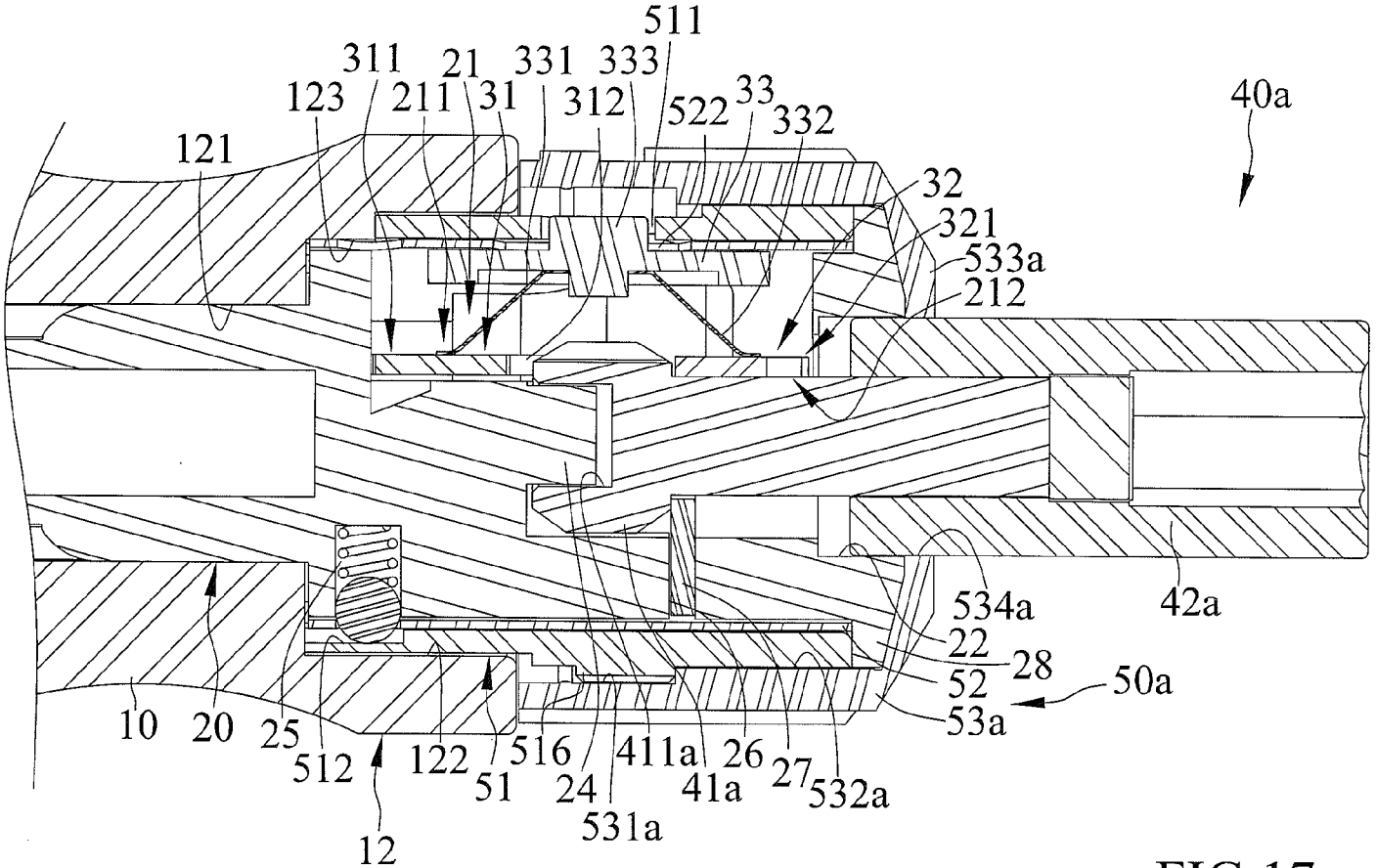
FIG. 17 is a cross-sectional view of the ratchet screwdriver shown in FIG. 16.
Figure 18:
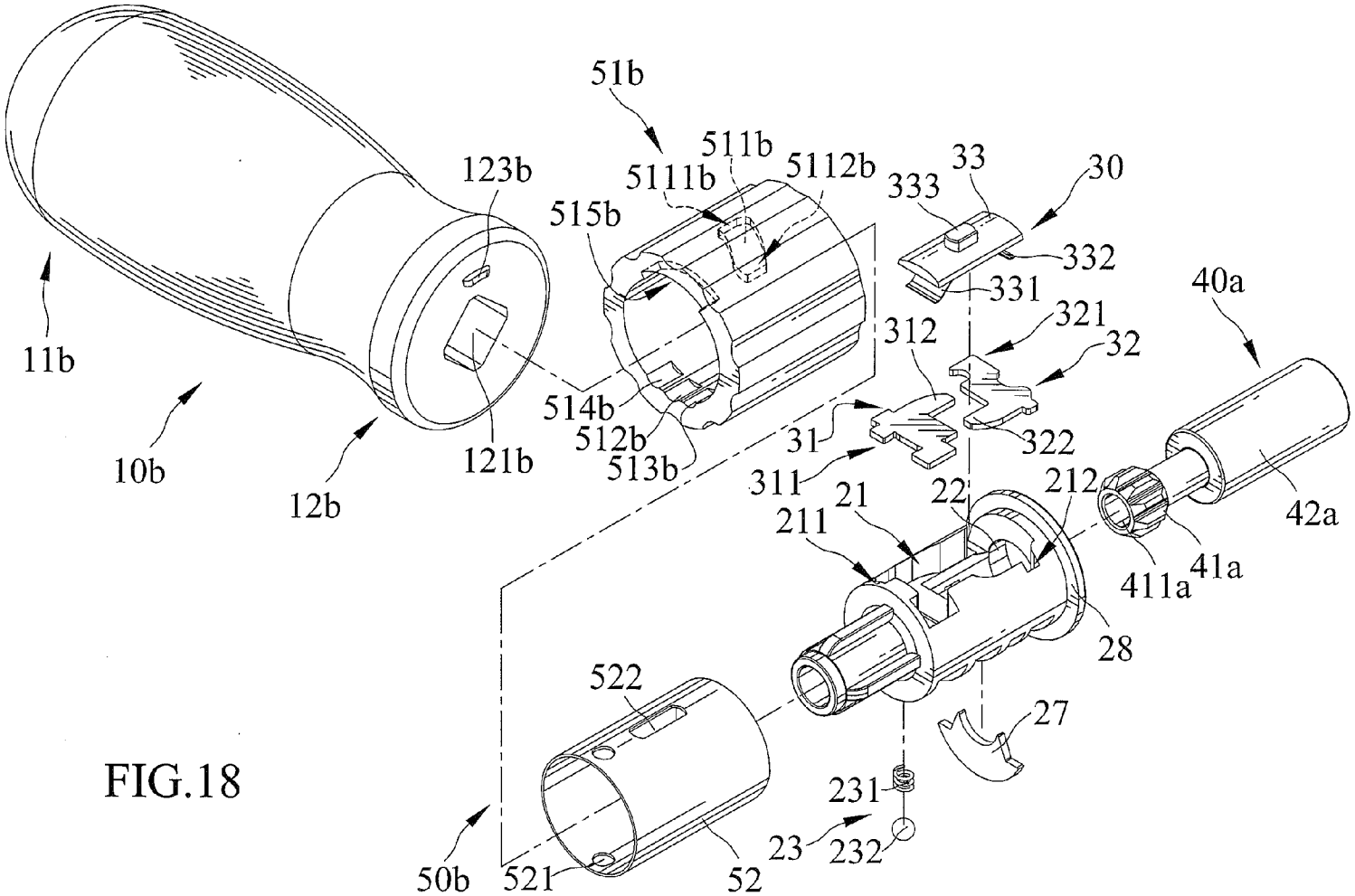
FIG. 18 is an exploded perspective view of the ratchet screwdriver in accordance with a third embodiment of the present invention.
Figure 19:
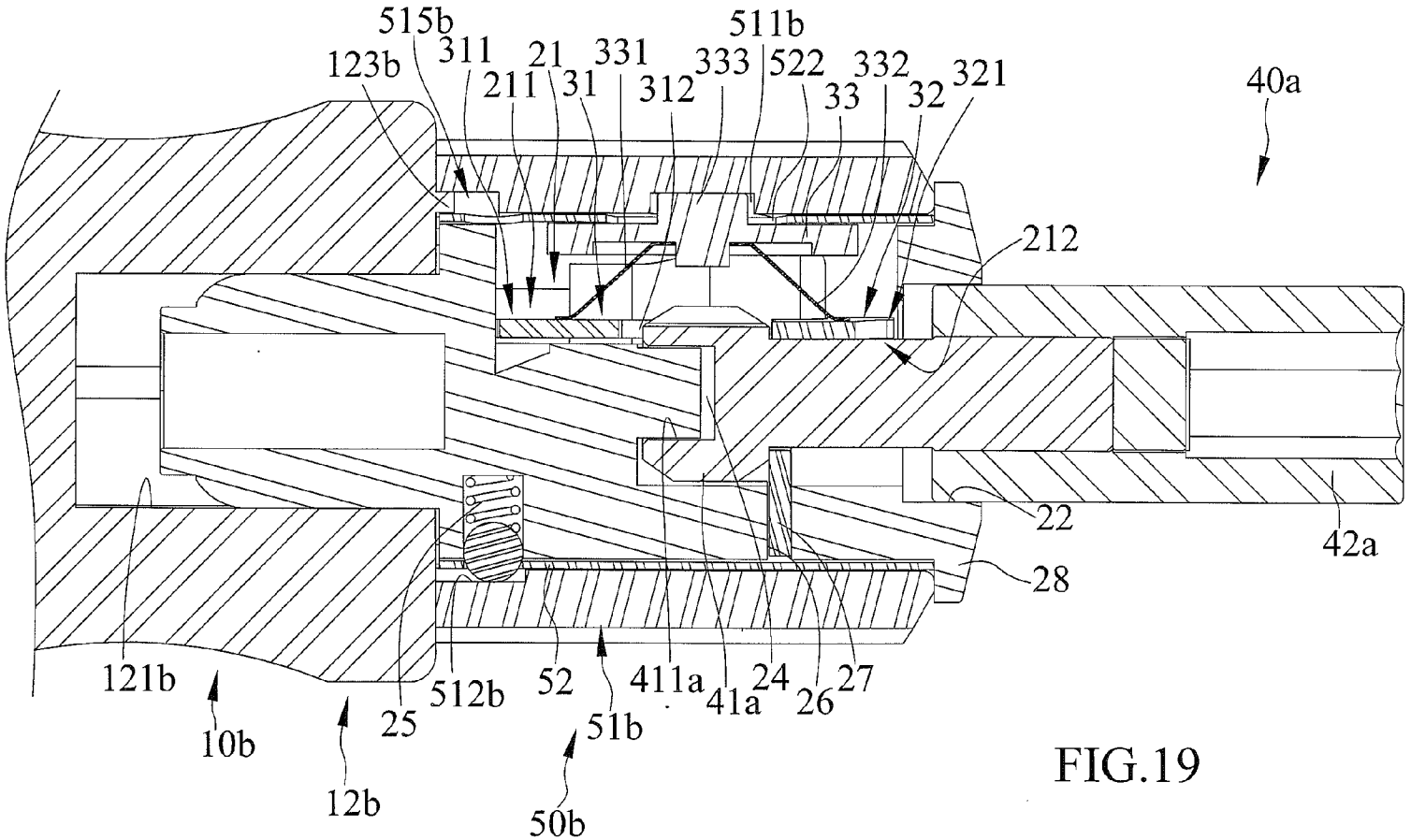
FIG. 19 is a cross-sectional view of the ratchet screwdriver of FIG. 18 illustrating the plate body abutting against the first pawl and the second pawl.
Figure 21:
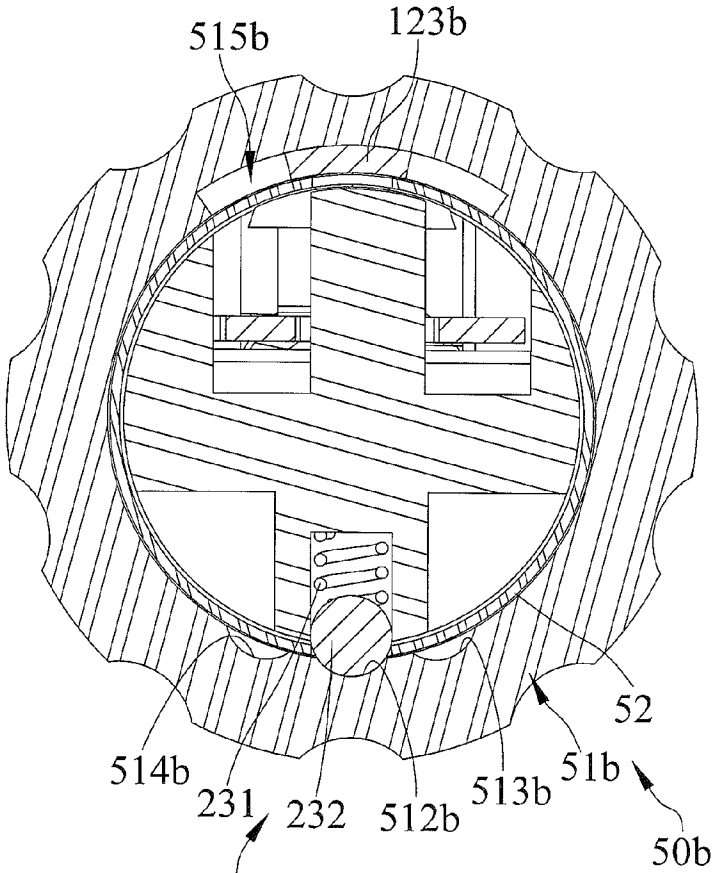
FIG. 21 is a cross-sectional view of the ratchet screwdriver of FIG. 18 illustrating a position unit engaged in the first bore in accordance with the third embodiment of the present invention.
Figure 20:
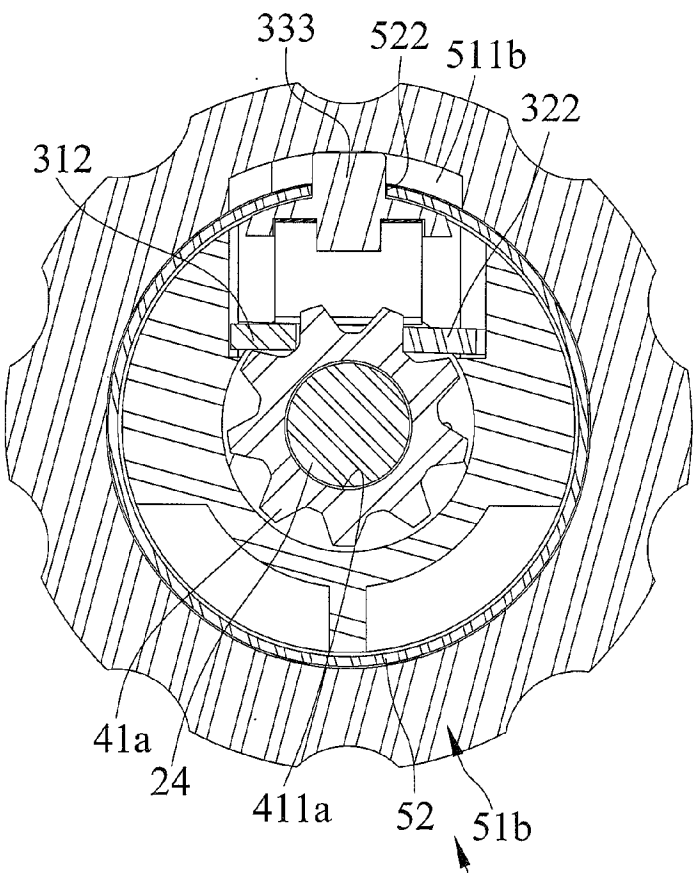
FIG. 20 is a cross-sectional view of the ratchet screwdriver of FIG. 18 illustrating the first and second pawls engaged with a ratchet portion.

FIGS. 16 and 17 show the ratchet screwdriver in accordance with a second embodiment of the present invention. The second embodiment differentiates from the first embodiment in that it includes a shank 40*a* and an adjusting assembly 50*a*. The shank 40*a* includes a ratchet portion 41*a* and a tubular body 42*a* formed opposite to the ratchet portion 41*a*. The ratchet portion 41*a* includes a tip slot 411*a* formed axially thereon. The ratchet portion 41*a* enters the recess 21 via the axial hole 22, and protrudes out the recess 21. The tubular body 42*a* is able to connect a screwdriver bit. The tip slot 411*a* receives the raised portion 24, so that the impeding element 27 abuts against a distal end of the ratchet portion 41*a*. The impeding element 27 avoids the shank 40*a* departing from the main body 20. The adjusting assembly 50*a* includes an adjusting ring 51, a sheath 52, and a sleeve 53*a*. The structure of the adjusting ring 51 and the sheath 52 are similar to the first embodiment substantially. An inner circumference of the sleeve 53*a* includes a resisting area 531*a* and a packing area 532*a* disposed adjacent the resisting area 531*a* in a stepped drop way. A diameter of the packing area 532*a* is less than a diameter of the resisting area 531*a*. The sleeve 53*a* includes a capping portion 533*a* formed on a distal end of the sleeve 53*a*, and a through hole 534*a* disposed on the capping portion 533*a*. The sleeve 53*a* receives the adjusting ring 51 and the main body 20. The capping portion 533*a* abuts against a distal end of the flange 28. The adjusting ring 51 is restricted by the flange 28 of the main body 20, so that the adjusting ring 51 does not depart from the main body 20. The sleeve 53*a* receives the adjusting ring 51, and the sleeve 53 can not depart from the adjusting ring 51.

FIGS. 18 through 21 show the ratchet screwdriver in accordance with a third embodiment of the present invention. The third embodiment differentiates from the first embodiment in that it includes a handle 10*b*, a shank 40*a*, and an adjusting assembly 50*b*. The structure of the shank 40*a* is similar to the second embodiment substantially. The handle 10*b* includes a holding end 11*b* and a connecting end 12*b* opposite to the holding end 11*b*. The holding end 11*b* is held by the user. The connecting end 12*b* includes a compelling hole 121*b* and a block 123*b* formed on a distal surface of the connecting end 12*b*. The adjusting assembly 50*b* includes an adjusting ring 51*b* and a sheath 52. The adjusting ring 51*b* receives the main body 20 and abuts against the flange 28. The structure of the sheath 52 is similar to the first embodiment substantially. The adjusting ring 51*b* includes a slanting slot 511*b*, a first bore 512*b*, a second bore 513*b*, a third bore 514*b*, and a cap 515*b*. The slanting slot 511*b* includes a first end 5111*b* and a second end 5112*b* disposed opposite to the first end 5111*b* therein. The rib 333 of the plate body 33 is exposed from the slanting slot 511*b*. The position assembly 23 is selectable to abut against the first, second, and third bores 512*b*, 513*b*, and 514*b*. The gap 515*b* formed on a side of the adjusting ring 51*b* forming the slanting slot 511*b*. The first, second, and third bores 512*b*, 513*b*, and 514*b* are disposed on a side of the adjusting ring 51*b* opposite to the slanting slot 511*b*. The adjusting ring 51*b* and the sheath 52 abut against the flange 28, so that the adjusting ring 51*b* and the sheath 52 can not depart from the main body 20.

Deliberative but not limiting descriptions of the embodiments of the present invention have been made. However, it should be understood that the technical staffs in this field may make changes and/or modifications without being away from the related scope of protection as defined in the Claims.

What is claimed is:

1. A ratchet screwdriver comprising:

a handle including a holding end and a connecting end opposite to the holding end;

a main body connecting with the connecting end, wherein the main body includes a recess disposed radially and an axial hole disposed axially connecting and in communication with the recess, with the main body further including a position assembly;

a shifter including a first pawl, a second pawl, and a plate body having a first surface and a second surface opposite to the first surface, with a first foot and a second foot protruding from the first surface, with the second foot being opposite to the first foot on the first surface, with the first and second pawls located in the recess, wherein the plate body further includes a rib protruding from the second surface opposite to the first and second feet, wherein the first foot abuts against the first pawl and the second foot abuts against the second pawl;

a shank including a ratchet portion and a tubular body, with the ratchet portion entering in the recess via the axial hole, with the tubular body able to connect a screwdriver bit; and an adjusting assembly receiving the main body, with the adjusting assembly including a slanting slot, with the slanting slot including a first end and a second end disposed opposite to the first end;

wherein the adjusting assembly is rotatable with respect to the main body about an axis extending from the handle to the shank, with the adjusting assembly selectively changed between a first position, a second position, and a third position;

wherein the adjusting assembly is in the first position with the rib located between the first and second ends of the slanting slot, with the first and second pawls engaged with the ratchet portion, and with the shank capable of driving the screwdriver bit in a clockwise direction or a counterclockwise direction;

wherein the adjusting assembly in the second position with the rib located at the first end of the slanting slot, with the first pawl engaged with the ratchet portion, with the second foot abutting against the second pawl to make the second pawl depart from the ratchet portion, and with the shank capable of driving the screwdriver bit in the clockwise direction; and wherein the adjusting assembly is in the third position with the rib located at the second end of the slanting slot, with the first foot abutting against the first pawl to make the first pawl depart from the ratchet portion, with the second pawl engaged with the ratchet portion, and with the shank capable of driving the screwdriver bit in the counterclockwise direction.

2. The ratchet screwdriver as claimed in claim 1, wherein the main body further includes a receiving slot disposed radially, with the receiving slot receiving the position assembly including a resilient element and a ball, and with an end of the ball abutting against the resilient element and another end of the ball protruding from the receiving slot.

3. The ratchet screwdriver as claimed in claim 1, wherein the tubular body includes a fitting ring adjacent to the ratchet portion, with the fitting ring received in the axial hole.

4. The ratchet screwdriver as claimed in claim 1, wherein the recess includes a first limiting end and a second limiting end formed opposite to the first limiting end, with the first pawl including a first protruded piece and a first protruded edge disposed opposite to the first protruded piece, with the first protruded piece restricted by the first limiting end, and with the first protruded edge engaged with the ratchet portion;

wherein the second pawl includes a second protruded piece and a second protruded edge disposed opposite to the second protruded piece, with the second protruded piece restricted by the second limiting end, with the second protruded edge engaged with the ratchet portion, wherein the first and second feet are substantially formed in an inverse V-shape, and wherein the plate body is moveable with respect to the first and second pawls, with the first foot selectively abutting against the first pawl, and with the second foot selectively abutting against the second pawl.

5. A ratchet screwdriver comprising:

a handle including a holding end and a connecting end opposite to the holding end;

a main body connecting with the connecting end, wherein the main body includes a recess disposed radially and an axial hole disposed axially connecting and in communication with the recess, with the main body further including a position assembly, wherein the connecting end includes a compelling hole and a receiving hole communicating with the compelling hole, with the receiving hole having a block formed therein, with an end of the main body coupled in the compelling hole, with another end of the main body coupled in the receiving hole;

a shifter including a first pawl, a second pawl, and a plate body including a first foot, a second foot formed opposite to the first foot, with the first and second pawls located in the recess, wherein the shifter further includes a rib formed on a surface opposite to the first and second feet, wherein the first foot abuts against the first pawl and the second foot abuts against the second pawl;

a shank including a ratchet portion and a tubular body, with the ratchet portion entering in the recess via the axial hole, with the tubular body able to connect a screwdriver bit; and an adjusting assembly adapted to receive the main body, with the adjusting assembly including a slanting slot, with the slanting slot including a first end and a second end disposed opposite to the first end, with the adjusting assembly including a gap formed on a side of the adjusting assembly forming the slanting slot, wherein the adjusting assembly is rotatable with respect to the handle, with the gap receiving the block;

wherein the adjusting assembly includes a first bore, a second bore, and a third bore, with the position assembly selectively abutting against the first, second, or third bores, wherein the adjusting assembly is in the first position with the position assembly engaged in the first bore, wherein the adjusting assembly is in the second position with the position assembly engaged in the second bore, and wherein the adjusting assembly is in the third position with the position assembly engaged in the third bore;

wherein the adjusting assembly is rotatable with respect to the main body about an axis of the screwdriver extending from the handle to the shank, with the adjusting assembly selectively changed between a first position, a second position, and a third position;

wherein the adjusting assembly is in the first position with the rib located between the first and second ends of the slanting slot, with the first and second pawls engaged with the ratchet portion, and with the shank capable of driving the screwdriver bit in a clockwise direction or a counterclockwise direction;

wherein the adjusting assembly in the second position with the rib located at the first end of the slanting slot, with the first pawl engaged with the ratchet portion, with the second foot abutting against the second pawl to make the second pawl depart from the ratchet portion, and with the shank capable of driving the screwdriver bit in the clockwise direction; and wherein the adjusting assembly is in the third position with the rib located at the second end of the slanting slot, with the first foot abutting against the first pawl to make the first pawl depart from the ratchet portion, with the second pawl engaged with the ratchet portion, and with the shank capable of driving the screwdriver bit in the counterclockwise direction.

6. The ratchet screwdriver as claimed in claim 5, wherein the main body includes a raised portion formed axially therein, wherein the raised portion and the axial hole are extended along the axis, wherein the ratchet portion includes a tip slot formed axially therein, with the tip slot receiving the raised portion, wherein the main body includes a groove disposed opposite to the recess, with the groove connecting and communicating with the axial hole, and wherein the main body includes an impeding element received in the groove and entering in the recess, with the impeding element abutting against a distal end of the ratchet portion.

7. The ratchet screwdriver as claimed in claim 5, wherein the main body includes a flange formed opposite to the handle, and wherein the adjusting assembly includes an adjusting ring, with the slanting slot, the first, second, and third bores received in the adjusting ring, with the main body disposed in the adjusting ring, and with the adjusting ring abutting against the flange.

8. The ratchet screwdriver as claimed in claim 7, wherein the adjusting assembly includes a sheath, a sleeve, and a cap, with the sheath located between the adjusting ring and the main body, with the sheath abutting against the flange, with the cap located between the adjusting ring and the sleeve, with the first, second, and third bores disposed on a side of the adjusting ring opposite to the slanting slot, with the adjusting ring including a convex portion disposed with the slanting slot at a same radial position, with the sheath including an aperture and a sliding slot formed opposite to the aperture, with the sleeve being generally annular in shape, with an inner circumference of the sleeve including a resisting area and a packing area disposed adjacent the resisting area in a stepped drop way, and with a diameter of the packing area less than a diameter of the resisting area; and wherein the cap includes a packing portion, a cover portion, and a through hole formed on the cover portion, with the packing portion being generally annular in shape, with the cover portion formed on a distal end of the packing portion, with the cap receiving the main body and the adjusting ring, with the cover portion abutting against a distal end of the flange, with the packing portion received in the adjusting ring and located at the packing area, wherein the cap avoids the shank departing from the adjusting assembly, with the adjusting ring restricted by the flange, with the cap received in the adjusting ring by close fitting; wherein the sleeve and the cap depart from the adjusting ring, wherein the adjusting assembly is disposed in the first position with the rib protruding out the slanting slot, with the rib located between the first and second ends, with the first protruded piece restricted by the first limiting end, with the first foot abutting against the first pawl to engage the first protruded edge with the ratchet portion, and with the second protruded piece restricted by the second limiting end, with the second foot abutting against the second pawl to engage the second protruded edge with the ratchet portion.

9. The ratchet screwdriver as claimed in claim 7, wherein the adjusting assembly includes the adjusting ring, a sheath, and a sleeve, with an inner circumference of the sleeve including a resisting area and a packing area disposed adjacent the resisting area in a stepped drop way, with a diameter of the packing area less than a diameter of the resisting area, wherein the sleeve includes a capping portion formed on a distal end of the sleeve and a through hole disposed on the capping portion, with the sleeve receiving the adjusting ring and the main body, with the capping portion abutting against a distal end of the flange, with the adjusting ring restricted by the flange, wherein the adjusting ring is coupled with the main body, with the sleeve receiving the adjusting ring, and wherein the sleeve is coupled with the adjusting ring.

10. The ratchet screwdriver as claimed in claim 5, wherein the block is formed on a distal surface of the connecting end, wherein the main body includes a raised portion formed axially therein, wherein the raised portion and the axial hole are extended along the axis, wherein the ratchet portion includes a tip slot formed axially therein, with the tip slot receiving the raised portion, wherein the main body includes a groove disposed opposite to the recess, with the groove connecting and communicating with the axial hole, wherein the main body includes an impeding element received in the groove and entering in the recess, with the impeding element abutting against a distal end of the ratchet portion, wherein the adjusting assembly includes an adjusting ring and a sheath, with the adjusting ring receiving the main body, with the sheath located between the adjusting ring and the main body, wherein the main body includes a flange formed opposite to the handle, with the sheath abutting against the flange, wherein the adjusting ring includes a cap formed on a side of the adjusting ring forming the slanting slot, wherein the first, second, and third bores are disposed on a side of the adjusting ring opposite to the slanting slot, with the sheath including an aperture and a sliding slot formed opposite to the aperture, with the adjusting ring and the sheath abutting against the flange, and wherein the adjusting ring and the sheath are coupled with the main body.

* * * * *